US008104550B2

(12) United States Patent
Overstreet et al.

(10) Patent No.: US 8,104,550 B2
(45) Date of Patent: Jan. 31, 2012

(54) METHODS FOR APPLYING WEAR-RESISTANT MATERIAL TO EXTERIOR SURFACES OF EARTH-BORING TOOLS AND RESULTING STRUCTURES

(75) Inventors: James L. Overstreet, Tomball, TX (US); Michael L. Doster, Spring, TX (US); Mark E. Morris, Coraopolois, PA (US); Kenneth E. Gilmore, Cleveland, TX (US); Robert M. Welch, The Woodlands, TX (US); Danielle V. Roberts, Calgary (CA)

(73) Assignee: Baker Hughes Incorporated, Houston, TX (US)

( * ) Notice: Subject to any disclaimer, the term of this patent is extended or adjusted under 35 U.S.C. 154(b) by 149 days.

(21) Appl. No.: 11/864,482

(22) Filed: Sep. 28, 2007

(65) Prior Publication Data

US 2008/0083568 A1 Apr. 10, 2008

Related U.S. Application Data

(63) Continuation-in-part of application No. 11/513,677, filed on Aug. 30, 2006, now Pat. No. 7,703,555.

(60) Provisional application No. 60/848,154, filed on Sep. 29, 2006.

(51) Int. Cl.
*E21B 10/36* (2006.01)

(52) U.S. Cl. ..... 175/425; 175/434; 175/435

(58) Field of Classification Search ..... 175/425, 175/426, 434, 435
See application file for complete search history.

(56) References Cited

U.S. PATENT DOCUMENTS

| | | | | |
|---|---|---|---|---|
| 2,033,594 | A | 9/1931 | Stoody | |
| 2,407,642 | A | 9/1946 | Ashworth | |
| 2,660,405 | A | 11/1953 | Scott et al. | |
| 2,740,651 | A * | 4/1956 | Ortloff | 403/300 |
| 2,819,958 | A | 1/1958 | Abkowitz et al. | |
| 2,819,959 | A | 1/1958 | Abkowitz et al. | |
| 2,961,312 | A | 11/1960 | Elbaum | |

(Continued)

FOREIGN PATENT DOCUMENTS

AU 695583 2/1998

(Continued)

OTHER PUBLICATIONS

International Search Report for WO 2008/027484 A1 (PCT/US2007/019085), mailed Jan. 31, 2008 (4 pages).

(Continued)

*Primary Examiner* — David Bagnell
*Assistant Examiner* — Cathleen Hutchins
(74) *Attorney, Agent, or Firm* — TraskBritt

(57) ABSTRACT

Earth-boring tools include wear-resistant materials disposed in at least one recess formed in an exterior surface of a body thereof. Exposed surfaces of the wear-resistant material are substantially level with exterior surfaces of the body adjacent the wear-resistant material. In some embodiments, recesses may be formed in formation-engaging surfaces of blades of earth-boring rotary tools, adjacent one or more inserts secured to bodies of earth-boring tools, or adjacent one or more cutting elements secured to bodies of earth-boring tools. Methods of forming earth-boring tools include filling one or more recesses formed in an exterior surface of a body with wear-resistant material and causing exposed surfaces of the wear-resistant material to be substantially level with the exterior surface of the body.

6 Claims, 10 Drawing Sheets

U.S. PATENT DOCUMENTS

| | | | | |
|---|---|---|---|---|
| 3,158,214 | A | | 11/1964 | Wisler et al. |
| 3,180,440 | A | * | 4/1965 | Bridwell ..... 175/393 |
| 3,260,579 | A | | 7/1966 | Scales et al. |
| 2,906,654 | A | | 2/1968 | Abkowitz |
| 3,368,881 | A | | 2/1968 | Abkowitz et al. |
| 3,471,921 | A | | 10/1969 | Feenstra |
| 3,660,050 | A | | 5/1972 | Iler et al. |
| 3,727,704 | A | * | 4/1973 | Abplanalp ..... 175/434 |
| 3,757,879 | A | | 9/1973 | Wilder et al. |
| 3,768,984 | A | | 10/1973 | Foster, Jr. |
| 3,790,353 | A | | 2/1974 | Jackson et al. |
| 3,800,891 | A | | 4/1974 | White et al. |
| 3,942,954 | A | | 3/1976 | Frehn |
| 3,987,859 | A | | 10/1976 | Lichte |
| 3,989,554 | A | | 11/1976 | Wisler |
| 4,017,480 | A | | 4/1977 | Baum |
| 4,043,611 | A | | 8/1977 | Wallace |
| 4,047,828 | A | | 9/1977 | Makely |
| 4,059,217 | A | | 11/1977 | Woodward |
| 4,094,709 | A | | 6/1978 | Rozmus |
| 4,128,136 | A | | 12/1978 | Generoux |
| 4,173,457 | A | | 11/1979 | Smith |
| 4,198,233 | A | | 4/1980 | Frehn |
| 4,221,270 | A | | 9/1980 | Vezirian |
| 4,229,638 | A | | 10/1980 | Lichte |
| 4,233,720 | A | | 11/1980 | Rozmus |
| 4,243,727 | A | | 1/1981 | Wisler et al. |
| 4,252,202 | A | | 2/1981 | Purser, Sr. |
| 4,255,165 | A | | 3/1981 | Dennis et al. |
| 4,262,761 | A | | 4/1981 | Crow |
| 4,306,139 | A | | 12/1981 | Shinozaki et al. |
| 4,341,557 | A | | 7/1982 | Lizenby |
| 4,389,952 | A | | 6/1983 | Dreier et al. |
| 4,398,952 | A | | 8/1983 | Drake |
| 4,414,029 | A | | 11/1983 | Newman et al. |
| 4,455,278 | A | | 6/1984 | van Nederveen et al. |
| 4,499,048 | A | | 2/1985 | Hanejko |
| 4,499,795 | A | | 2/1985 | Radtke |
| 4,499,958 | A | | 2/1985 | Radtke et al. |
| 4,526,748 | A | | 7/1985 | Rozmus |
| 4,547,337 | A | | 10/1985 | Rozmus |
| 4,552,232 | A | | 11/1985 | Frear |
| 4,554,130 | A | | 11/1985 | Ecer |
| 4,562,892 | A | | 1/1986 | Ecer |
| 4,562,990 | A | | 1/1986 | Rose |
| 4,579,713 | A | | 4/1986 | Lueth |
| 4,596,694 | A | | 6/1986 | Rozmus |
| 4,597,456 | A | | 7/1986 | Ecer |
| 4,597,730 | A | | 7/1986 | Rozmus |
| 4,611,673 | A | | 9/1986 | Childers et al. |
| 4,630,692 | A | | 12/1986 | Ecer |
| 4,630,693 | A | | 12/1986 | Goodfellow |
| 4,656,002 | A | | 4/1987 | Lizenby et al. |
| 4,666,797 | A | | 5/1987 | Newman et al. |
| 4,667,756 | A | | 5/1987 | King et al. |
| 4,674,802 | A | | 6/1987 | McKenna et al. |
| 4,676,124 | A | | 6/1987 | Fischer |
| 4,686,080 | A | | 8/1987 | Hara et al. |
| 4,694,919 | A | | 9/1987 | Barr |
| 4,726,432 | A | | 2/1988 | Scott et al. |
| 4,743,515 | A | | 5/1988 | Fischer et al. |
| 4,744,943 | A | | 5/1988 | Timm |
| 4,762,028 | A | | 8/1988 | Regan |
| 4,781,770 | A | | 11/1988 | Kar |
| 4,809,903 | A | | 3/1989 | Eylon et al. |
| 4,814,234 | A | | 3/1989 | Bird |
| 4,836,307 | A | | 6/1989 | Keshavan et al. |
| 4,838,366 | A | | 6/1989 | Jones |
| 4,871,377 | A | | 10/1989 | Frushour |
| 4,884,477 | A | | 12/1989 | Smith et al. |
| 4,889,017 | A | | 12/1989 | Fuller et al. |
| 4,919,013 | A | | 4/1990 | Smith et al. |
| 4,923,512 | A | | 5/1990 | Timm et al. |
| 4,933,240 | A | | 6/1990 | Barber, Jr. |
| 4,938,991 | A | | 7/1990 | Bird |
| 4,944,774 | A | | 7/1990 | Keshavan et al. |
| 4,956,012 | A | | 9/1990 | Jacobs et al. |
| 4,968,348 | A | | 11/1990 | Abkowitz et al. |
| 5,000,273 | A | | 3/1991 | Horton et al. |
| 5,010,225 | A | | 4/1991 | Carlin |
| 5,030,598 | A | | 7/1991 | Hsieh |
| 5,032,352 | A | | 7/1991 | Meeks et al. |
| 5,038,640 | A | | 8/1991 | Sullivan et al. |
| 5,049,450 | A | | 9/1991 | Dorfman et al. |
| 5,051,112 | A | | 9/1991 | Keshavan et al. |
| 5,089,182 | A | | 2/1992 | Findeisen et al. |
| 5,090,491 | A | | 2/1992 | Tibbits et al. |
| 5,101,692 | A | | 4/1992 | Simpson |
| 5,150,636 | A | | 9/1992 | Hill |
| 5,152,194 | A | | 10/1992 | Keshavan et al. |
| 5,161,898 | A | | 11/1992 | Drake |
| 5,186,267 | A | | 2/1993 | White |
| 5,232,522 | A | | 8/1993 | Doktycz et al. |
| 5,242,017 | A | | 9/1993 | Hailey |
| 5,250,355 | A | | 10/1993 | Newman et al. |
| 5,281,260 | A | | 1/1994 | Kumar et al. |
| 5,286,685 | A | | 2/1994 | Schoennahl et al. |
| 5,291,807 | A | | 3/1994 | Vanderford et al. |
| 5,311,958 | A | | 5/1994 | Isbell et al. |
| 5,328,763 | A | | 7/1994 | Terry |
| 5,348,806 | A | | 9/1994 | Kojo et al. |
| 5,373,907 | A | | 12/1994 | Weaver |
| 5,433,280 | A | | 7/1995 | Smith |
| 5,439,068 | A | | 8/1995 | Huffstutler et al. |
| 5,443,337 | A | | 8/1995 | Katayama |
| 5,479,997 | A | | 1/1996 | Scott et al. |
| 5,482,670 | A | | 1/1996 | Hong |
| 5,484,468 | A | | 1/1996 | Ostlund et al. |
| 5,492,186 | A | | 2/1996 | Overstreet et al. |
| 5,506,055 | A | | 4/1996 | Dorfman et al. |
| 5,535,838 | A | | 7/1996 | Keshavan et al. |
| 5,543,235 | A | | 8/1996 | Mirchandani et al. |
| 5,544,550 | A | | 8/1996 | Smith |
| 5,560,440 | A | | 10/1996 | Tibbits |
| 5,586,612 | A | | 12/1996 | Isbell et al. |
| 5,589,268 | A | | 12/1996 | Kelley et al. |
| 5,593,474 | A | | 1/1997 | Keshavan et al. |
| 5,611,251 | A | | 3/1997 | Katayama |
| 5,612,264 | A | | 3/1997 | Nilsson et al. |
| 5,641,251 | A | | 6/1997 | Leins et al. |
| 5,641,921 | A | | 6/1997 | Dennis et al. |
| 5,653,299 | A | | 8/1997 | Sreshta et al. |
| 5,662,183 | A | | 9/1997 | Fang |
| 5,663,512 | A | | 9/1997 | Schader et al. |
| 5,666,864 | A | | 9/1997 | Tibbits |
| 5,677,042 | A | | 10/1997 | Massa et al. |
| 5,679,445 | A | | 10/1997 | Massa et al. |
| 5,697,046 | A | | 12/1997 | Conley |
| 5,697,462 | A | | 12/1997 | Grimes et al. |
| 5,732,783 | A | | 3/1998 | Truax et al. |
| 5,733,649 | A | | 3/1998 | Kelley et al. |
| 5,733,664 | A | | 3/1998 | Kelley et al. |
| 5,740,872 | A | | 4/1998 | Smith |
| 5,753,160 | A | | 5/1998 | Takeuchi et al. |
| 5,755,298 | A | | 5/1998 | Langford, Jr. et al. |
| 5,765,095 | A | | 6/1998 | Flak et al. |
| 5,776,593 | A | | 7/1998 | Massa et al. |
| 5,778,301 | A | | 7/1998 | Hong |
| 5,789,686 | A | | 8/1998 | Massa et al. |
| 5,791,422 | A | | 8/1998 | Liang et al. |
| 5,791,423 | A | | 8/1998 | Overstreet et al. |
| 5,792,403 | A | | 8/1998 | Massa et al. |
| 5,806,934 | A | | 9/1998 | Massa et al. |
| 5,830,256 | A | | 11/1998 | Northrop et al. |
| 5,856,626 | A | | 1/1999 | Fischer et al. |
| 5,865,571 | A | | 2/1999 | Tankala et al. |
| 5,880,382 | A | | 3/1999 | Fang et al. |
| 5,893,204 | A | | 4/1999 | Symonds |
| 5,896,940 | A | | 4/1999 | Pietrobelli et al. |
| 5,897,830 | A | | 4/1999 | Abkowitz et al. |
| 5,904,212 | A | | 5/1999 | Arfele |
| 5,921,330 | A | | 7/1999 | Sue et al. |
| 5,924,502 | A | | 7/1999 | Arfele et al. |
| 5,954,147 | A | | 9/1999 | Overstreet |
| 5,957,006 | A | | 9/1999 | Smith |
| 5,963,775 | A | | 10/1999 | Fang |
| 5,967,248 | A | | 10/1999 | Drake et al. |

| | | | | |
|---|---|---|---|---|
| 5,988,302 | A | 11/1999 | Sreshta et al. | |
| 5,988,303 | A | 11/1999 | Arfele | |
| 6,029,544 | A | 2/2000 | Katayama | |
| 6,045,750 | A | 4/2000 | Drake et al. | |
| 6,051,171 | A | 4/2000 | Takeuchi et al. | |
| 6,063,333 | A | 5/2000 | Dennis | |
| 6,068,070 | A | 5/2000 | Scott | |
| 6,073,518 | A | 6/2000 | Chow et al. | |
| 6,086,980 | A | 7/2000 | Foster et al. | |
| 6,089,123 | A | 7/2000 | Chow et al. | |
| 6,099,664 | A | 8/2000 | Davies et al. | |
| 6,124,564 | A | 9/2000 | Sue et al. | |
| 6,131,677 | A | 10/2000 | Arfele et al. | |
| 6,148,936 | A | 11/2000 | Evans et al. | |
| 6,196,338 | B1 | 3/2001 | Slaughter et al. | |
| 6,200,514 | B1 | 3/2001 | Meister | |
| 6,206,115 | B1 | 3/2001 | Overstreet et al. | |
| RE37,127 | E | 4/2001 | Schader et al. | |
| 6,209,420 | B1 | 4/2001 | Butcher et al. | |
| 6,214,134 | B1 | 4/2001 | Eylon et al. | |
| 6,214,287 | B1 | 4/2001 | Waldenstrom | |
| 6,220,117 | B1 | 4/2001 | Butcher | |
| 6,227,188 | B1 | 5/2001 | Tankala et al. | |
| 6,228,139 | B1 | 5/2001 | Oskarrson | |
| 6,234,261 | B1 * | 5/2001 | Evans et al. | 175/374 |
| 6,241,036 | B1 | 6/2001 | Lovato et al. | |
| 6,248,149 | B1 | 6/2001 | Massey et al. | |
| 6,254,658 | B1 | 7/2001 | Taniuchi et al. | |
| 6,287,360 | B1 | 9/2001 | Kembaiyan et al. | |
| 6,290,438 | B1 | 9/2001 | Papajewski | |
| 6,293,986 | B1 | 9/2001 | Rodiger et al. | |
| 6,348,110 | B1 | 2/2002 | Evans | |
| 6,349,780 | B1 | 2/2002 | Beuershausen | |
| 6,360,832 | B1 | 3/2002 | Overstreet et al. | |
| 6,375,706 | B2 | 4/2002 | Kembaiyan et al. | |
| 6,450,271 | B1 | 9/2002 | Tibbitts | |
| 6,453,899 | B1 | 9/2002 | Tselesin | |
| 6,454,025 | B1 | 9/2002 | Runquist et al. | |
| 6,454,028 | B1 | 9/2002 | Evans | |
| 6,454,030 | B1 | 9/2002 | Findley et al. | |
| 6,458,471 | B2 | 10/2002 | Lovato et al. | |
| 6,474,425 | B1 | 11/2002 | Truax et al. | |
| 6,500,226 | B1 | 12/2002 | Dennis | |
| 6,511,265 | B1 | 1/2003 | Mirchandani et al. | |
| 6,568,491 | B1 | 5/2003 | Matthews, III et al. | |
| 6,575,350 | B2 | 6/2003 | Evans et al. | |
| 6,576,182 | B1 | 6/2003 | Ravagni et al. | |
| 6,589,640 | B2 | 7/2003 | Griffin et al. | |
| 6,599,467 | B1 | 7/2003 | Yamaguchi et al. | |
| 6,607,693 | B1 | 8/2003 | Saito et al. | |
| 6,615,936 | B1 | 9/2003 | Mourik et al. | |
| 6,651,756 | B1 * | 11/2003 | Costo, Jr. et al. | 175/374 |
| 6,655,481 | B2 | 12/2003 | Findley | |
| 6,659,206 | B2 | 12/2003 | Liang et al. | |
| 6,663,688 | B2 | 12/2003 | Findeisen et al. | |
| 6,685,880 | B2 | 2/2004 | Engstrom et al. | |
| 6,725,952 | B2 | 4/2004 | Singh | |
| 6,742,608 | B2 | 6/2004 | Murdoch | |
| 6,742,611 | B1 | 6/2004 | Illlerhaus et al. | |
| 6,756,009 | B2 | 6/2004 | Sim et al. | |
| 6,766,870 | B2 | 7/2004 | Overstreet | |
| 6,772,849 | B2 | 8/2004 | Oldham et al. | |
| 6,782,958 | B2 | 8/2004 | Liang et al. | |
| 6,849,231 | B2 | 2/2005 | Kojima et al. | |
| 6,861,612 | B2 | 3/2005 | Bolton et al. | |
| 6,918,942 | B2 | 7/2005 | Hatta et al. | |
| 6,948,403 | B2 | 9/2005 | Singh | |
| 7,044,243 | B2 | 5/2006 | Kembaiyan et al. | |
| 7,048,081 | B2 | 5/2006 | Smith et al. | |
| 7,240,746 | B2 | 7/2007 | Overstreet et al. | |
| 2001/0015290 | A1 | 8/2001 | Sue et al. | |
| 2001/0017224 | A1 | 8/2001 | Evans et al. | |
| 2002/0004105 | A1 | 1/2002 | Kunze et al. | |
| 2003/0010409 | A1 | 1/2003 | Kunze et al. | |
| 2004/0013558 | A1 | 1/2004 | Kondoh et al. | |
| 2004/0060742 | A1 | 4/2004 | Kembaiyan et al. | |
| 2004/0196638 | A1 | 10/2004 | Lee et al. | |
| 2004/0234821 | A1 | 11/2004 | Majagi | |
| 2004/0243241 | A1 | 12/2004 | Istephanous et al. | |
| 2004/0245022 | A1 | 12/2004 | Izaguirre et al. | |
| 2004/0245024 | A1 | 12/2004 | Kembaiyan | |
| 2005/0000317 | A1 | 1/2005 | Liang et al. | |
| 2005/0008524 | A1 | 1/2005 | Testani | |
| 2005/0072496 | A1 | 4/2005 | Hwang et al. | |
| 2005/0084407 | A1 | 4/2005 | Myrick | |
| 2005/0117984 | A1 | 6/2005 | Eason et al. | |
| 2005/0126334 | A1 | 6/2005 | Mirchandani | |
| 2005/0211475 | A1 | 9/2005 | Mirchandani et al. | |
| 2005/0247491 | A1 | 11/2005 | Mirchandani et al. | |
| 2005/0268746 | A1 | 12/2005 | Abkowitz et al. | |
| 2006/0016521 | A1 | 1/2006 | Hanusiak et al. | |
| 2006/0032677 | A1 | 2/2006 | Azar et al. | |
| 2006/0043648 | A1 | 3/2006 | Takeuchi et al. | |
| 2006/0057017 | A1 | 3/2006 | Woodfield et al. | |
| 2006/0131081 | A1 | 6/2006 | Mirchandani et al. | |
| 2006/0185908 | A1 | 8/2006 | Kembaiyan et al. | |
| 2007/0042217 | A1 | 2/2007 | Fang et al. | |
| 2007/0056776 | A1 | 3/2007 | Overstreet | |
| 2007/0056777 | A1 | 3/2007 | Overstreet | |
| 2007/0102198 | A1 | 5/2007 | Oxford et al. | |
| 2007/0102199 | A1 | 5/2007 | Smith et al. | |
| 2007/0102200 | A1 | 5/2007 | Choe et al. | |
| 2007/0163812 | A1 | 7/2007 | Overstreet et al. | |
| 2007/0205023 | A1 * | 9/2007 | Hoffmaster et al. | 175/408 |
| 2008/0053709 | A1 * | 3/2008 | Lockstedt et al. | 175/426 |

FOREIGN PATENT DOCUMENTS

| | | | |
|---|---|---|---|
| CA | 2212197 | | 10/2000 |
| EP | 0 264 674 | A2 | 4/1988 |
| EP | 0 453 428 | A1 | 10/1991 |
| EP | 0 995 876 | A2 | 4/2000 |
| EP | 1 244 531 | B1 | 10/2002 |
| GB | 945227 | | 12/1963 |
| GB | 1070039 | | 5/1967 |
| GB | 2104101 | A | 3/1983 |
| GB | 2203774 | A | 10/1988 |
| GB | 2295157 | A | 5/1996 |
| GB | 2352727 | A | 2/2001 |
| GB | 2357788 | A | 4/2001 |
| GB | 2 385 350 | A | 8/2003 |
| GB | 2 393 449 | A | 3/2004 |
| JP | 10 219385 | A | 8/1998 |
| WO | 03049889 | A2 | 6/2003 |
| WO | 2004053197 | A2 | 6/2004 |
| WO | 2006099629 | A1 | 9/2006 |
| WO | 2007030707 | A1 | 3/2007 |

OTHER PUBLICATIONS

"Boron Carbide Nozzles and Inserts," Seven Stars International webpage http://www.concentric.net/~ctkang/nozzle.shtml, printed Sep. 7, 2006.

"Heat Treating of Titanium and Titanium Alloys," Key to Metals website article, www.key-to-metals.com, (no date).

Alman, D.E., et al., "The Abrasive Wear of Sintered Titanium Matrix-Ceramic Particle Reinforced Composites," WEAR, 225-229 (1999), pp. 629-639.

Choe, Heeman, et al., "Effect of Tungsten Additions on the Mechanical Properties of Ti-6A1-4V," Material Science and Engineering, A 396 (2005), pp. 99-106, Elsevier.

Diamond Innovations, "Composite Diamond Coatings, Superhard Protection of Wear Parts New Coating and Service Parts from Diamond Innovations" brochure, 2004.

Gale, W.F., et al., Smithells Metals Reference Book, Eighth Edition, 2003, p. 2,117, Elsevier Butterworth Heinemann.

Miserez, A., et al. "Particle Reinforced Metals of High Ceramic Content," Material Science and Engineering A 387-389 (2004), pp. 822-831, Elsevier.

PCT International Search Report PCT Counterpart Application No. PCT/US2006/043669, mailed Apr. 13, 2007.

PCT International Search Report for PCT Counterpart Application No. PCT/US2006/043670, mailed Apr. 2, 2007.

Reed, James S., "Chapter 13: Particle Packing Characteristics," Principles of Ceramics Processing, Second Edition, John Wiley & Sons, Inc. (1995), pp. 215-227.

www.matweb.com "Wall Comonoy Colmonoy 4 Hard-surfacing alloy with chromium boride" from www.matweb.com, 1 page, printed Mar. 19, 2009.

Wall Colmonoy "Colmonoy Alloy Selector Chart" 2003, pp. 1 and 2.

PCT International Search Report for PCT/US2007/021072, mailed Feb. 27, 2008.

Warrier, S.G., et al., "Infiltration of Titanium Alloy-Matrix Composites," Journal of Materials Science Letters, 12 (1993), pp. 865-868, Chapman & Hall.

PCT International Search Report for PCT/US2007/021071, mailed Feb. 6, 2008.

Smith International, Inc., Smith Bits Product Catalog 2005-2006, p. 45.

PCT International Search Report for counterpart PCT International Application No. PCT/US2007/023275, mailed Apr. 11, 2008.

International Search Report for WO 2007/030707 A1 (PCT/US2006/035010), mailed Dec. 27, 2006 (3 pages).

International Application Search Report for International Application No. PCT/US2009/048232 mailed Feb. 2, 2010, 5 pages.

Written Opinion for International Application No. PCT/US2009/048232 mailed Feb. 2, 2010, 4 pages.

PCT Written Opinion for International Application No. PCT/US2007/019085, mailed Jan. 31, 2008.

PCT Written Opinion for International Application No. PCT/US2006/035010, mailed Dec. 27, 2006.

US 4,966,627, 10/1990, Keshavan et al. (withdrawn)

* cited by examiner

METHODS FOR APPLYING WEAR-RESISTANT MATERIAL TO EXTERIOR SURFACES OF EARTH-BORING TOOLS AND RESULTING STRUCTURES

CROSS-REFERENCE TO RELATED APPLICATIONS

This application claims the benefit of Provisional U.S. Patent Application Ser. No. 60/848,154, which was filed Sep. 29, 2006, the disclosure of which is incorporated herein in its entirety by this reference. Additionally, this application is a continuation-in-part of U.S. patent application Ser. No. 11/513,677, which was filed Aug. 30, 2006, and is now U.S. Pat. No. 7,703,555, issued Apr. 27, 2010, the disclosure of which is also incorporated herein in its entirety by this reference. The subject matter of this application is also related to the subject matter of U.S. patent application Ser. No. 12/702,100, filed Feb. 8, 2010, which is a divisional of U.S. patent application Ser. No. 11/513,677, filed Dec. 30, 2006, now U.S. Pat. No. 7,703,555, issued Apr. 27, 2010, U.S. patent application Ser. No. 12/350,761, filed Jan. 8, 2009, which is a divisional of U.S. patent application Ser. No. 11/223,215, filed Sep. 9, 2005, now U.S. Pat. No. 7,597,159, issued Oct. 6, 2009, U.S. patent application Ser. No. 11/862,719, filed Sep. 27, 2007, now U.S. Pat. No. 7,997,359, issued Aug. 16, 2011, and U.S. patent application Ser. No. 13/023,882, filed Feb. 9, 2011, pending, which is a divisional of U.S. patent application Ser. No. 11/862,719, filed Sep. 27, 2007, now U.S. Pat. No. 7,997,359, issued Aug. 16, 2011.

FIELD OF THE INVENTION

The present invention relates generally to rotary drill bits and other earth-boring tools, to methods of fabricating earth-boring tools, and to methods of enhancing the wear-resistance of earth-boring tools.

BACKGROUND OF THE INVENTION

Earth-boring rotary drill bits are commonly used for drilling boreholes or wells in earth formations. One type of rotary drill bit is the fixed-cutting element bit (often referred to as a "drag" bit), which typically includes a plurality of cutting elements secured to a face and gage regions of a bit body. Generally, the cutting elements of a fixed-cutting element-type drill bit have either a disk shape or, in some instances, a more elongated, substantially cylindrical shape. A cutting surface comprising a hard, superabrasive material, such as mutually bound particles of polycrystalline diamond forming a so-called "diamond table," may be provided on a substantially circular end surface of a substrate of each cutting element. Such cutting elements are often referred to as "polycrystalline diamond compact" (PDC) cutting elements. Typically, the PDC cutting elements are fabricated separately from the bit body and secured within pockets formed in an outer surface of the bit body. A bonding material such as an adhesive or, more typically, a braze alloy may be used to secure the cutting elements to the bit body.

The bit body of an earth-boring rotary drill bit may be secured to a hardened steel shank having American Petroleum Institute (API) standard threads for connecting the drill bit to a drill string. The drill string includes tubular pipe and equipment segments coupled end to end between the drill bit and other drilling equipment at the surface. Equipment such as a rotary table or top drive may be used for rotating the drill string and the drill bit within the borehole. Alternatively, the shank of the drill bit may be coupled directly to the drive shaft of a down-hole motor, which then may be used to rotate the drill bit.

Referring to FIG. 1, a conventional fixed-cutting element rotary drill bit 10 includes a bit body 12 that has generally radially projecting and longitudinally extending wings or blades 14, which are separated by junk slots 16. A plurality of PDC cutting elements 18 are provided on the face 20 of the blades 14 extending over face 20 of the bit body 12. The face 20 of the bit body 12 includes the surfaces of the blades 14 that are configured to engage the formation being drilled, as well as the exterior surfaces of the bit body 12 within the channels and junk slots 16. The plurality of PDC cutting elements 18 may also be provided along each of the blades 14 within pockets 22 formed in the blades 14, and may be supported from behind by buttresses 24, which may be integrally formed with the bit body 12.

The drill bit 10 may further include an API threaded connection portion 30 for attaching the drill bit 10 to a drill string (not shown). Furthermore, a longitudinal bore (not shown) extends longitudinally through at least a portion of the bit body 12, and internal fluid passageways (not shown) provide fluid communication between the longitudinal bore and nozzles 32 provided at the face 20 of the bit body 12 and opening onto the channels leading to junk slots 16.

During drilling operations, the drill bit 10 is positioned at the bottom of a wellbore and rotated while drilling fluid is pumped through the longitudinal bore, the internal fluid passageways, and the nozzles 32 to the face 20 of the bit body 12. As the drill bit 10 is rotated, the PDC cutting elements 18 scrape across and shear away the underlying earth formation. The formation cuttings mix with and are suspended within the drilling fluid and pass through the junk slots 16 and up through an annular space between the wall of the borehole and an outer surface of the drill string to the surface of the earth formation.

BRIEF SUMMARY OF THE INVENTION

In some embodiments, the present invention includes earth-boring tools having wear-resistant material disposed in one or more recesses extending into a body from an exterior surface. Exposed surfaces of the wear-resistant material may be substantially level with the exterior surface of the bit body adjacent the wear-resistant material. The one or more recesses may extend along an edge defined by an intersection between exterior surfaces of the body, adjacent one or more wear-resistant inserts in the body, and/or adjacent one or more cutting elements affixed to the body.

In additional embodiments, the present invention includes methods of forming earth-boring tools. The methods include providing wear-resistant material in at least one recess in an exterior surface of a bit body, and causing exposed surfaces of the wear-resistant material to be substantially level with the exterior surface of the bit body adjacent the wear-resistant material.

BRIEF DESCRIPTION OF THE SEVERAL VIEWS OF TE DRAWINGS

While the specification concludes with claims particularly pointing out and distinctly claiming that which is regarded as the present invention, various features and advantages of this invention may be more readily ascertained from the following description of the invention when read in conjunction with the accompanying drawings, in which:

Figure 11:
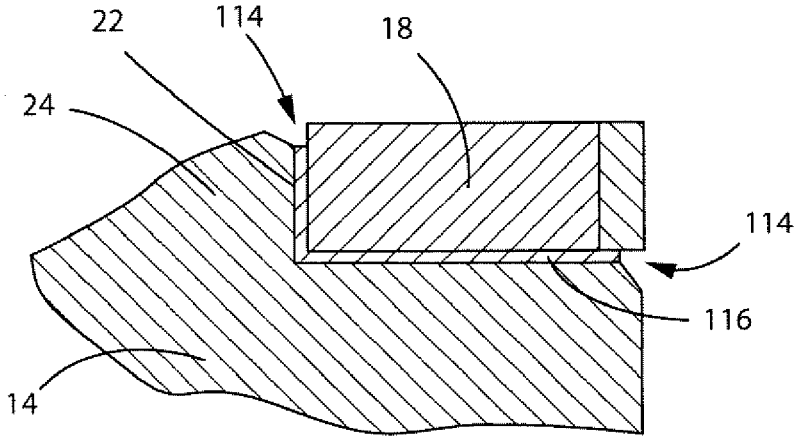
FIG. 11 is another cross-sectional view of a portion of the cutting element and blade shown in FIG. 9, taken generally parallel to the longitudinal axis of the cutting element, further illustrating the recesses formed generally around the periphery of the cutting element.
Figure 14:
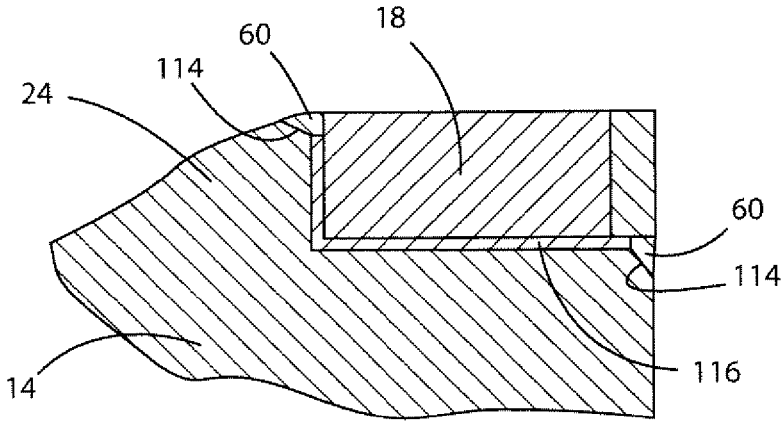
Figure 15:
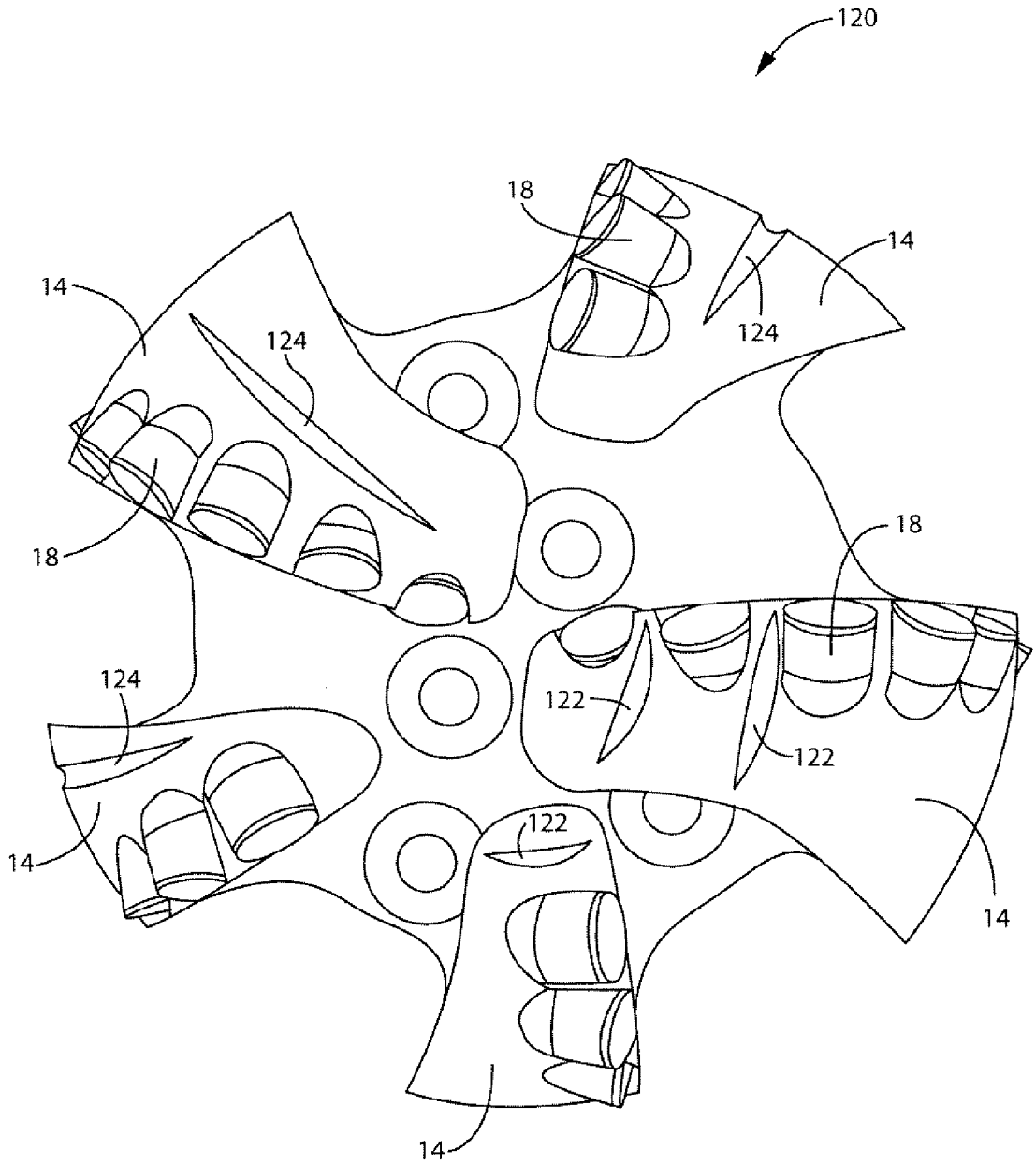

FIG. 14 is a cross-sectional view of the cutting element and blade similar to that shown in FIG. 11 and further illustrating the abrasive wear-resistant material provided in the recesses formed around the periphery of the cutting element; and FIG. 15 is an end view of yet another fixed-cutting element earth-boring rotary drill bit generally illustrating recesses formed in nose and cone regions of blades of the drill bit for receiving abrasive wear-resistant material therein.

DETAILED DESCRIPTION OF THE INVENTION

The illustrations presented herein are, in some instances, not actual views of any particular drill bit, cutting element, or other feature of a drill bit, but are merely idealized representations which are employed to describe the present invention. Additionally, elements common between figures may retain the same numerical designation.

Figure 1:
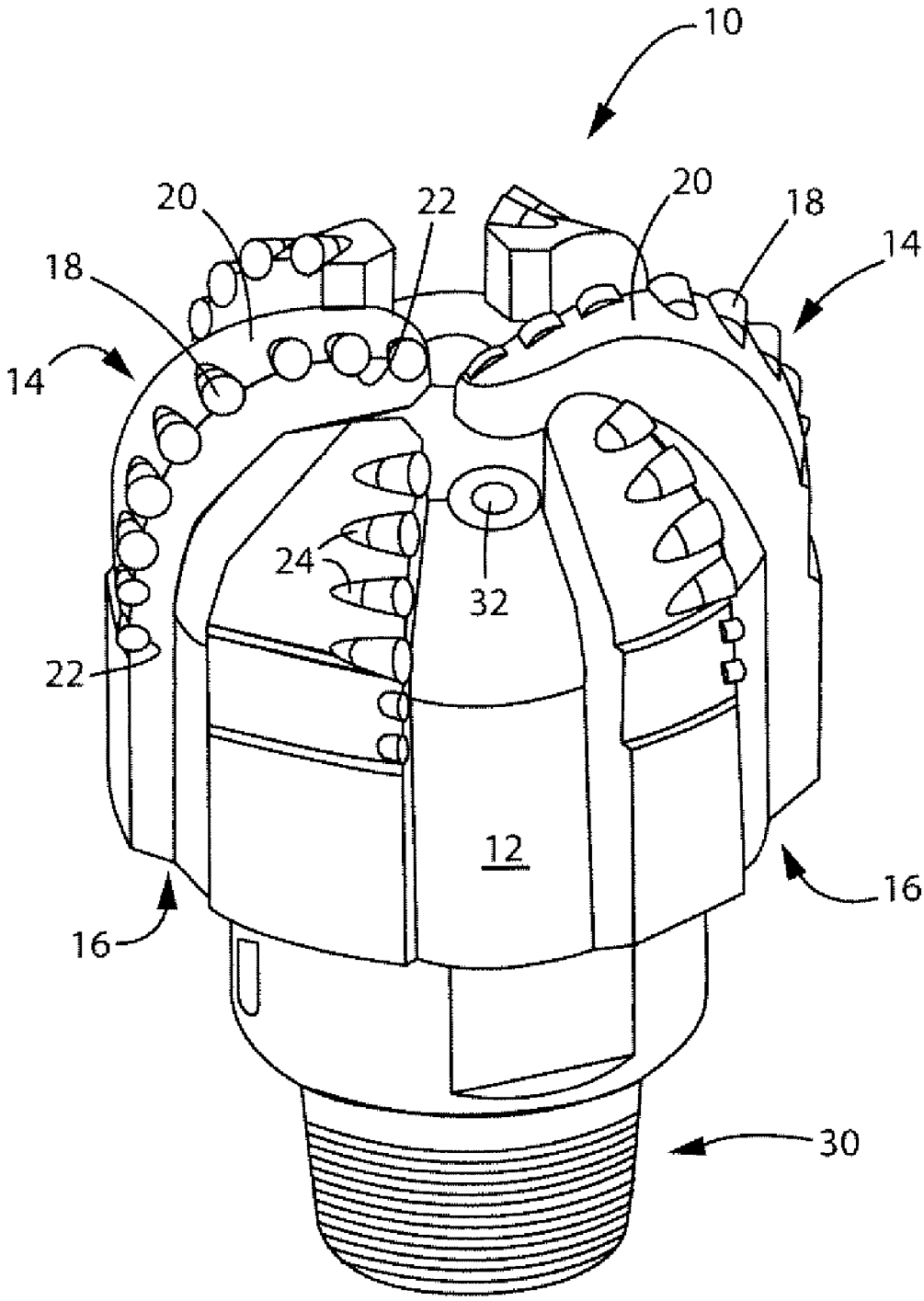
FIG. 1 is a perspective view of an exemplary fixed-cutting element earth-boring rotary drill bit.
Figure 2:
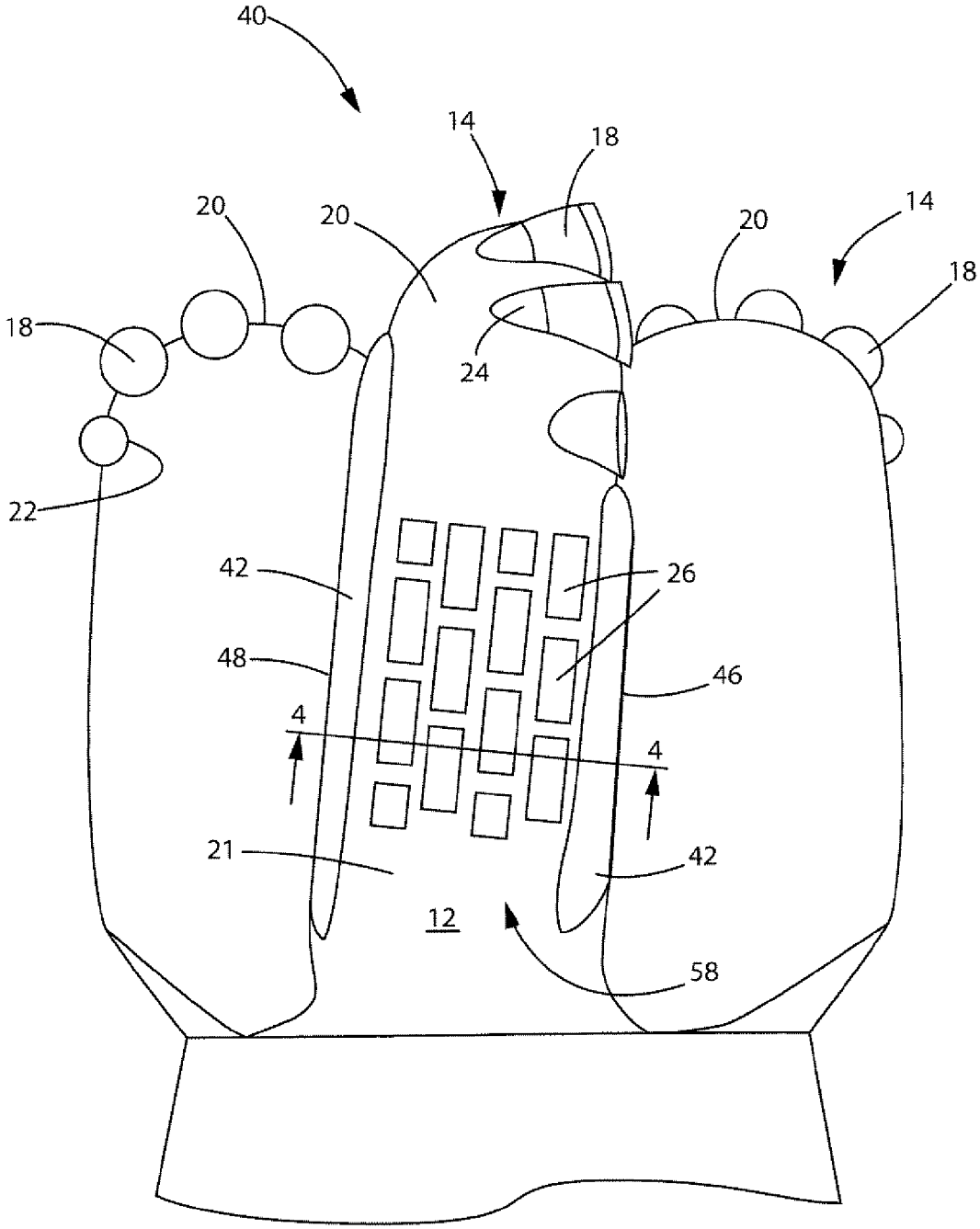
FIG. 2 is a side view of another fixed-cutting element earth-boring rotary drill bit illustrating generally longitudinally extending recesses formed in a blade of the drill bit for receiving abrasive wear-resistant material therein.

The present invention may be used to enhance the wear resistance of earth-boring rotary drill bits. An embodiment of an earth-boring rotary drill bit 40 of the present invention is shown in FIG. 2. The drill bit 40 is generally similar to the drill bit 10 previously described with reference to FIG. 1, and includes a plurality of blades 14 separated by junk slots 16.

Figure 3:
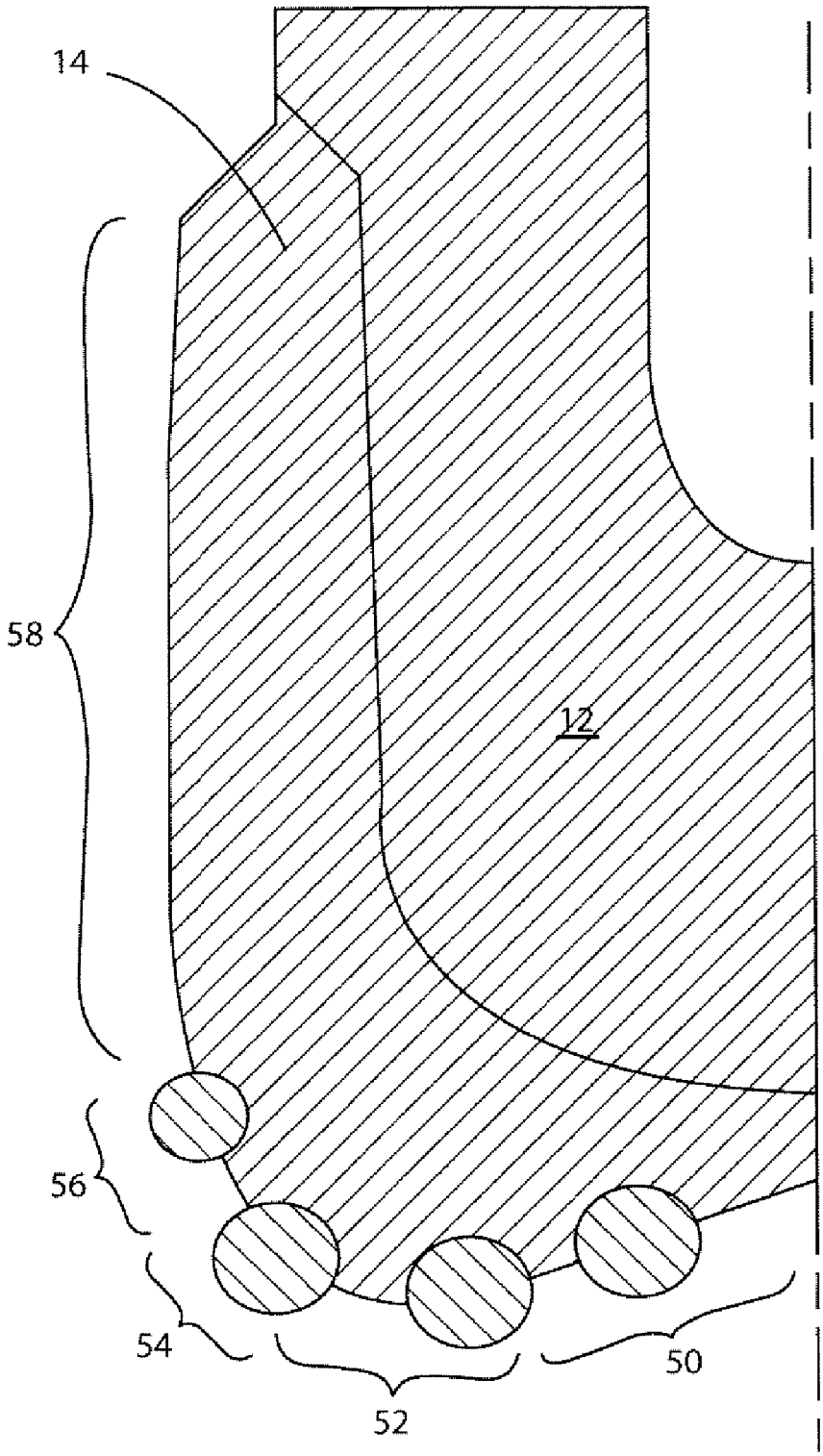
FIG. 3 is a partial cross-sectional side view of one blade of the drill bit shown in FIG. 2 illustrating the various portions thereof.

FIG. 3 is a partial cross-sectional side view of one blade 14 of the drill bit 10 shown in FIG. 2. As shown in FIG. 3, each of the blades 14 may include a cone region 50 (a region having the shape of an inverted cone), a nose region 52, a flank region 54, a shoulder region 56, and a gage region 58 (the flank region 54 and the shoulder region 56 may be collectively referred to in the art as either the "flank" or the "shoulder" of the blade). In additional embodiments, the blades 14 may not include a cone region 50. Each of these regions includes an exposed outer surface that is configured to engage the subterranean formation within the wellbore during drilling. The cone region 50, nose region 52 and flank region 54 are configured to engage the formation surfaces at the bottom of the wellbore and to support the majority of the weight-on-bit (WOB). These regions carry a majority of the cutting elements 18 for cutting or scraping away the underlying formation at the bottom of the wellbore. The shoulder region 56 and the gage region 58 are configured to engage the formation surfaces on the lateral sides of the wellbore.

As the formation-engaging surfaces of the various regions of the blades 14 slide or scrape against the formation, the material of the blades 14 has a tendency to wear away at the formation-engaging surfaces. This wearing away of the material of the blades 14 at the formation-engaging surfaces can lead to loss of cutting elements and/or bit instability (e.g., bit whirl), which may further lead to catastrophic failure of the drill bit 40.

In an effort to reduce the wearing away of the material of the blades 14 at the formation-engaging surfaces, various wear-resistant structures and materials have been placed on and/or in these exposed outer surfaces of the blades 14. For example, inserts such as bricks, studs, and wear knots formed from abrasive wear-resistant materials, such as, for example, tungsten carbide, have been inset in formation-engaging surfaces of blades 14.

Referring again to FIG. 2, a plurality of wear-resistant inserts 26 (each of which may comprise, for example, a tungsten carbide brick) may be inset within the blade 14 at the formation-engaging surface 21 of the blade 14 in the gage region 58 thereof. In additional embodiments, the blades 14 may include wear-resistant structures on or in formation-engaging surfaces of other regions of the blades 14, including the cone region 50, nose region 52, flank region 54, and shoulder region 56 (FIG. 3). For example, abrasive wear-resistant inserts may be provided on or in the formation-engaging surfaces of at least one of the cone region 50 and the nose region 52 of the blades rotationally behind one or more cutting elements 18.

Conventionally, abrasive wear-resistant material (i.e., hardfacing material) also may be applied at selected locations on the formation-engaging surfaces of the blades 14. For example, an oxyacetylene torch or an arc welder, for example, may be used to at least partially melt a wear-resistant material, and the molten wear-resistant material may be applied to the formation-engaging surfaces of the blades 14 and allowed to cool and solidify.

In embodiments of the present invention, recesses may be formed in one or more formation-engaging surfaces of the drill bit 40, and the recesses may be filled with wear-resistant material. As a non-limiting example, recesses 42 for receiving abrasive wear-resistant material therein may be formed in the blades 14, as shown in FIG. 2. The recesses 42 may extend generally longitudinally along one or more of the blades 14. A longitudinally extending recess 42 may be formed or otherwise provided along, or proximate to, the edge defined by the intersection between the formation-engaging surface 21 and the rotationally leading surface 46 of one or more of the blades 14. In addition, a longitudinally extending recess 42 may be formed or otherwise provided along, or proximate to, the edge defined by the intersection between the formation-engaging surface 21 and the rotationally trailing surface 48 of the blade 14. Optionally, one or more of the recesses 42 may extend along the blade 14 adjacent (e.g., rotationally forward and rotationally behind) to one or more wear-resistant inserts 26, as also shown in FIG. 2.

Figure 4:
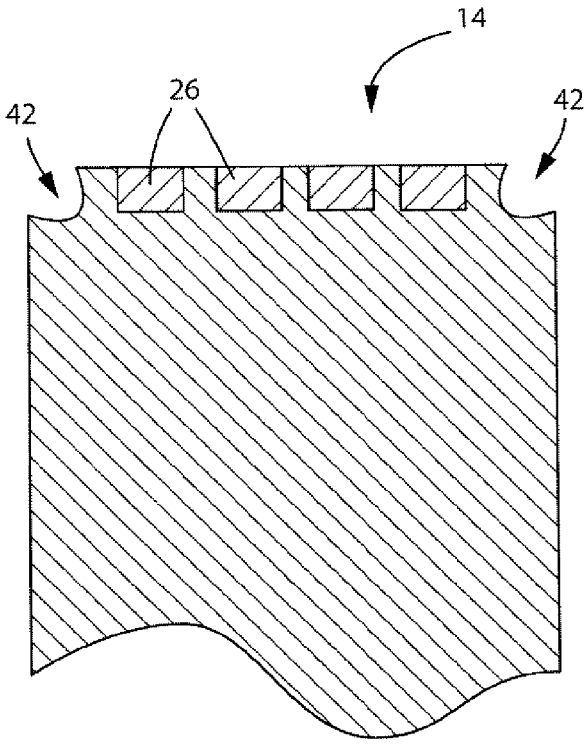
FIG. 4 is a cross-sectional view of a blade of the drill bit illustrated in FIG. 2, taken generally perpendicular to the longitudinal axis of the drill bit, further illustrating the recesses formed in the blade for receiving abrasive wear-resistant material therein.

FIG. 4 is a cross-sectional view of the blade 14 shown in FIG. 2 taken along section line 4-4 shown therein. As shown in FIG. 4, the recesses 42 may have a generally semicircular cross-sectional shape. In additional embodiments, however, the recesses 42 may have any cross-sectional shape such as, for example, generally triangular, generally rectangular (e.g., square), or any other shape.

The manner in which the recesses 42 are formed or otherwise provided in the blades 14 may depend on the material from which the blades 14 have been formed. For example, if the blades 14 comprise steel or another metal alloy, the recesses 42 may be formed in the blades 14 using, for example, a standard milling machine or other standard machining tool (including hand-held machining tools). If, however, the blades 14 comprise a relatively harder and less machinable particle-matrix composite material, the recesses 42 may be provided in the blades 14 during formation of the blades 14. Bit bodies 12 of drill bits that comprise particle-matrix composite materials are conventionally formed by casting the bit bodies 12 in a mold. To form the recesses 42 in such bit bodies 12, inserts or displacements comprising a ceramic or other refractory material and having shapes corresponding to the desired shapes of the recesses to be formed in the bit body 12 may be provided at selected locations within the mold that correspond to the selected locations in the bit body 12 at which the recesses are to be formed. After casting or otherwise forming a bit body 12 around the inserts or displacements within a mold, the bit body 12 may be removed from the mold and the inserts or displacements removed from the bit body 12 to form the recesses 42. Additionally, recesses 42 may be formed in bit bodies 12 comprising particle-matrix composite materials using ultrasonic machining techniques, which may include applying ultrasonic vibrations to a machining tool as the machining tool is used to form the recesses 42 in a bit body 12.

The present invention is not limited by the manner in which the recesses 42 are formed in the blades 14 of the bit body 12 of the drill bit 40, and any method that can be used to form the recesses 42 in a particular drill bit 40 may be used to provide drill bits that embody teachings of the present invention.

Figure 5:
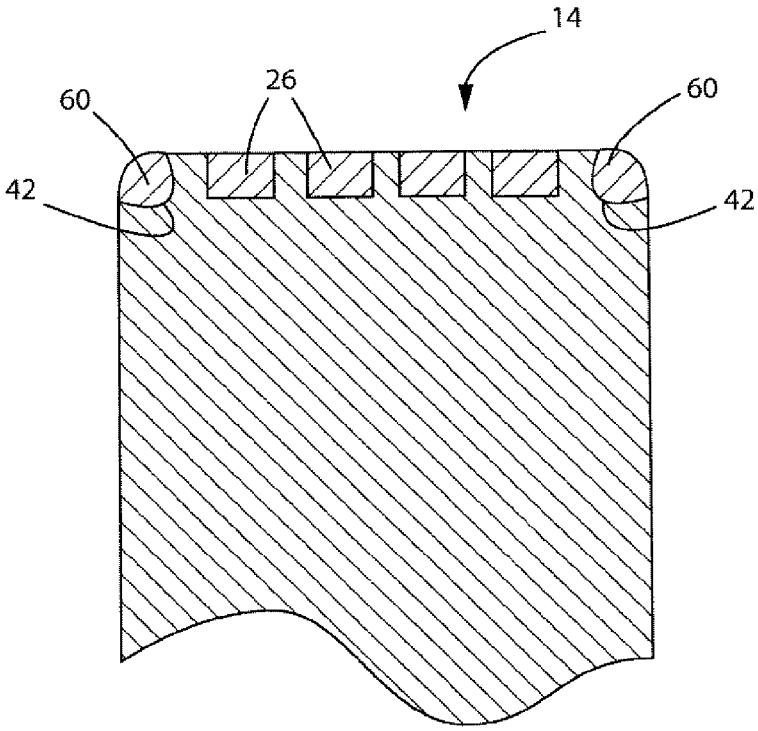
FIG. 5 is a cross-sectional view of the blade of the drill bit illustrated in FIG. 2 similar to that shown in FIG. 4, and further illustrating abrasive wear-resistant material disposed in the recesses previously provided in the blade.

Referring to FIG. 5, abrasive wear-resistant material 60 may be provided in the recesses 42 after the recesses 42 have been formed in the formation-engaging surfaces of the blades 14. In some embodiments, the exposed exterior surfaces of the abrasive wear-resistant material 60 provided in the recesses 42 may be substantially coextensive with the adjacent exposed exterior surfaces of the blades 14. In other words, the abrasive wear-resistant material 60 may not project significantly outward from the surface of the blades 14. In this configuration, the topography of the exterior surface of the blades 14 after filling the recesses 42 with the abrasive wear-resistant material 60 may be substantially similar to the topography of the exterior surface of the blades 14 prior to forming the recesses 42. Stated yet another way, the exposed surfaces of the abrasive wear-resistant material 60 may be substantially level with the surface of the blade 14 adjacent the abrasive wear-resistant material 60 in a direction generally perpendicular to the surface of the blade 14 adjacent the abrasive wear-resistant material 60.

The forces applied to the exterior surfaces of the blades 14 may be more evenly distributed across the blades 14 in a manner intended by the bit designer by substantially maintaining the original topography of the exterior surfaces of the blades 14, as discussed above. In contrast, increased localized stresses may develop within the blades 14 in the areas proximate any abrasive wear-resistant material 60 that projects from the exterior surfaces of the blades 14 as the formation engages such projections of abrasive wear-resistant material 60. The magnitude of such increased localized stresses may be generally proportional to the distance by which the projections extend from the surface of the blades 14 in the direction toward the formation being drilled. Such increased localized stresses may be reduced or eliminated by configuring the exposed exterior surfaces of the abrasive wear-resistant material 60 to substantially match the exposed exterior surfaces of the blades 14 prior to forming the recesses 42, which may lead to decreased wear and increased service life of the drill bit 40.

The recesses 42 previously described herein in relation to FIGS. 2, 4, and 5 extend in a generally longitudinal direction relative to the drill bit 40. Furthermore, the recesses 42 are shown therein as being located generally in the gage region of the blades 14 of the bit 40 and extending along the edges defined between the intersections between the formation-engaging surfaces 21 of the blades 14 and the rotationally leading surfaces 46 and the rotationally trailing surfaces 48 of the blades 14. The present invention is not so limited, and recesses filled with abrasive wear-resistant material may be provided in any region of a bit body of a drill bit (including any region of a blade 14, as well as regions that are not on blades 14), according to the present invention. Furthermore, recesses 42 filled with abrasive wear-resistant material 60 may have any shape and any orientation in embodiments of drill bits according to the present invention.

Figure 6:
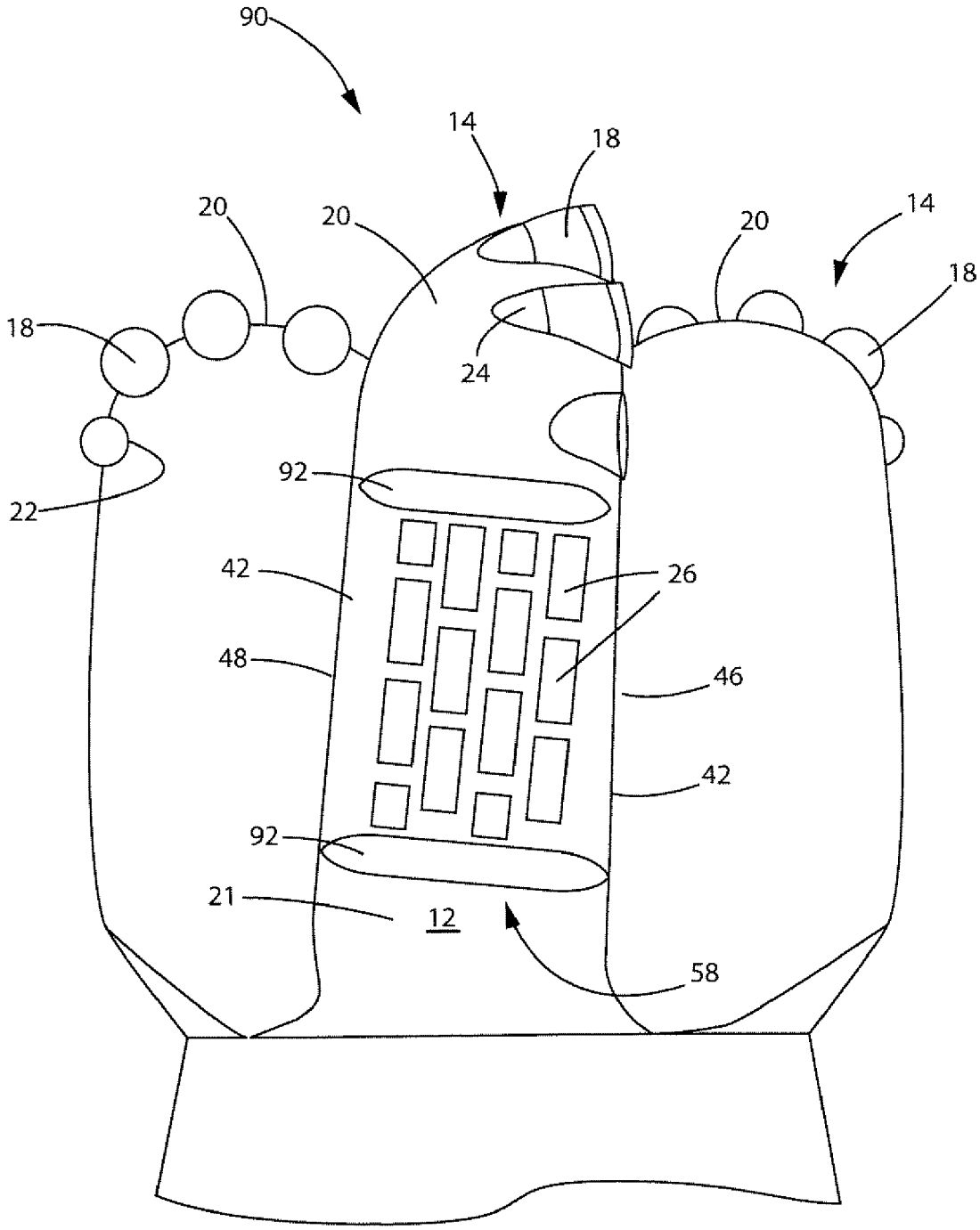
FIG. 6 is a side view of another fixed-cutting element earth-boring rotary drill bit, similar to that shown in FIG. 2, illustrating generally circumferentially extending recesses formed in a blade of the drill bit for receiving abrasive wear-resistant material therein.

FIG. 6 illustrates another embodiment of a drill bit 90 of the present invention. The drill bit 90 is generally similar to the drill bit 40 as previously described with reference to FIG. 2, and includes a plurality of blades 14 separated by junk slots 16. A plurality of wear-resistant inserts 26 are inset within the formation-engaging surface 21 of each blade 14 in the gage region 58 thereof. The drill bit 90 further includes a plurality of recesses 92 formed adjacent the region of each blade 14 comprising the plurality of wear-resistant inserts 26. The recesses 92 may be generally similar to the recesses 42 previously described herein in relation to FIGS. 2, 4, and 5. The recesses 92, however, extend generally circumferentially around the drill bit 90 in a direction generally parallel to the direction of rotation of the drill bit 90 during drilling.

Figure 7:
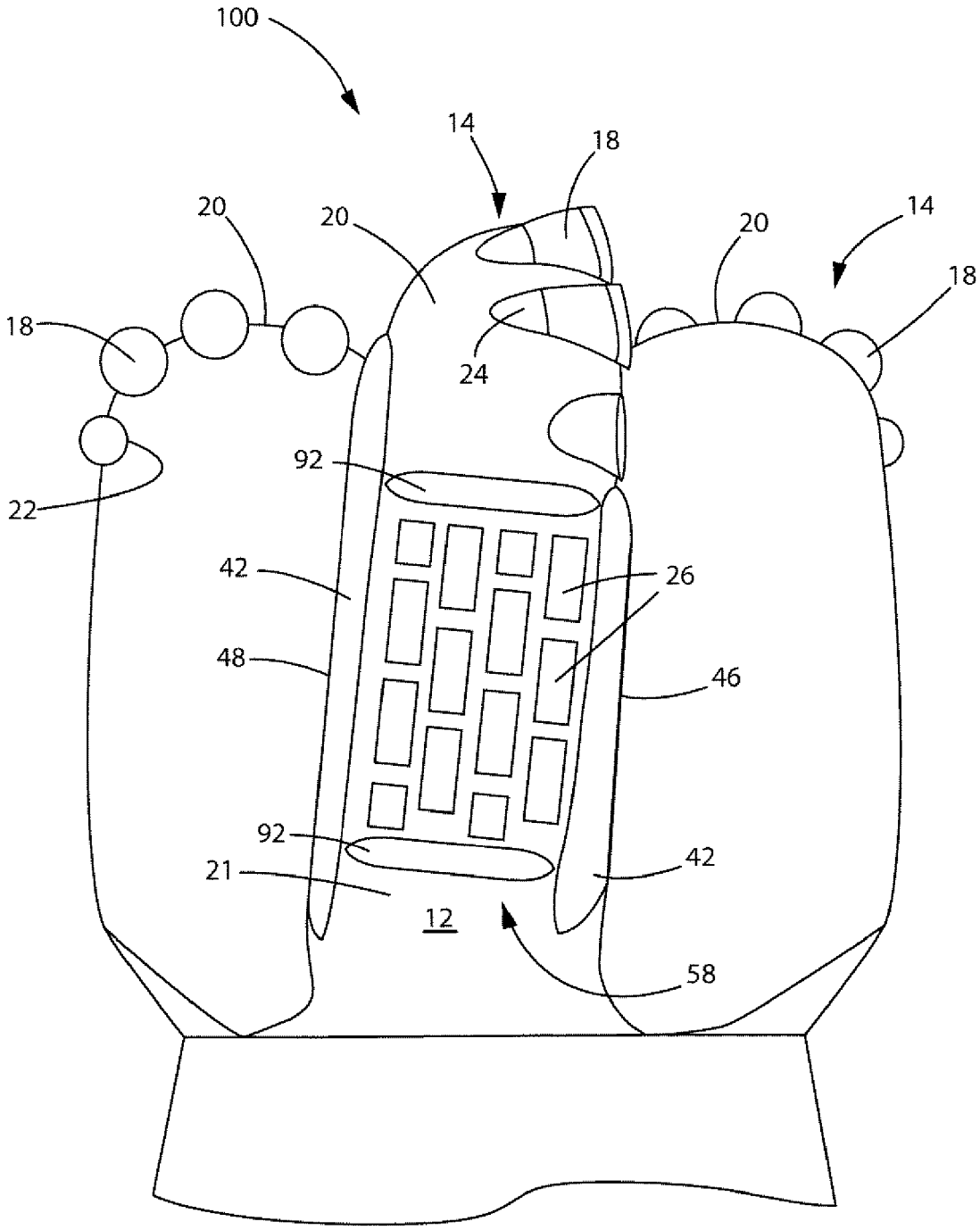
FIG. 7 is a side view of yet another fixed-cutting element earth-boring rotary drill bit, similar to those shown in FIGS. 2 and 6, illustrating both generally longitudinally extending recesses and generally circumferentially extending recesses formed in a blade of the drill bit for receiving abrasive wear-resistant material therein.

FIG. 7 illustrates yet another embodiment of a drill bit 100 of the present invention. The drill bit 100 is generally similar to the drill bit 40 and the drill bit 90 and includes a plurality of blades 14, junk slots 16, and wear-resistant inserts 26 inset within the formation-engaging surface 21 of each blade 14 in the gage region 58 thereof. The drill bit 100, however, includes both generally longitudinally extending recesses 42 (like those of the drill bit 40) and generally circumferentially extending recesses 92 (like those of the drill bit 90). In this configuration, each plurality of wear-resistant inserts 26 may be substantially peripherally surrounded by recesses 42, 92 that are filled with abrasive wear-resistant material 60 (FIG. 5) generally up to the exposed exterior surface of the blades 14. By substantially surrounding the periphery of each region of the blade 14 comprising a plurality of wear-resistant inserts 26, wearing away of the material of the blade 14 adjacent the plurality of wear-resistant inserts 26 may be reduced or eliminated, which may prevent loss of one or more of the wear-resistant inserts 26 during drilling.

In the embodiment shown in FIG. 7, the regions of the blades 14 comprising a plurality of wear-resistant inserts 26 are substantially peripherally surrounded by recesses 42, 92 that may be filled with abrasive wear-resistant material 60 (FIG. 5). In additional embodiments, one or more wear-resistant inserts 26 of a drill bit may be individually substantially peripherally surrounded by recesses (like the recesses 42, 92) filled with abrasive wear-resistant material 60.

Figure 8:
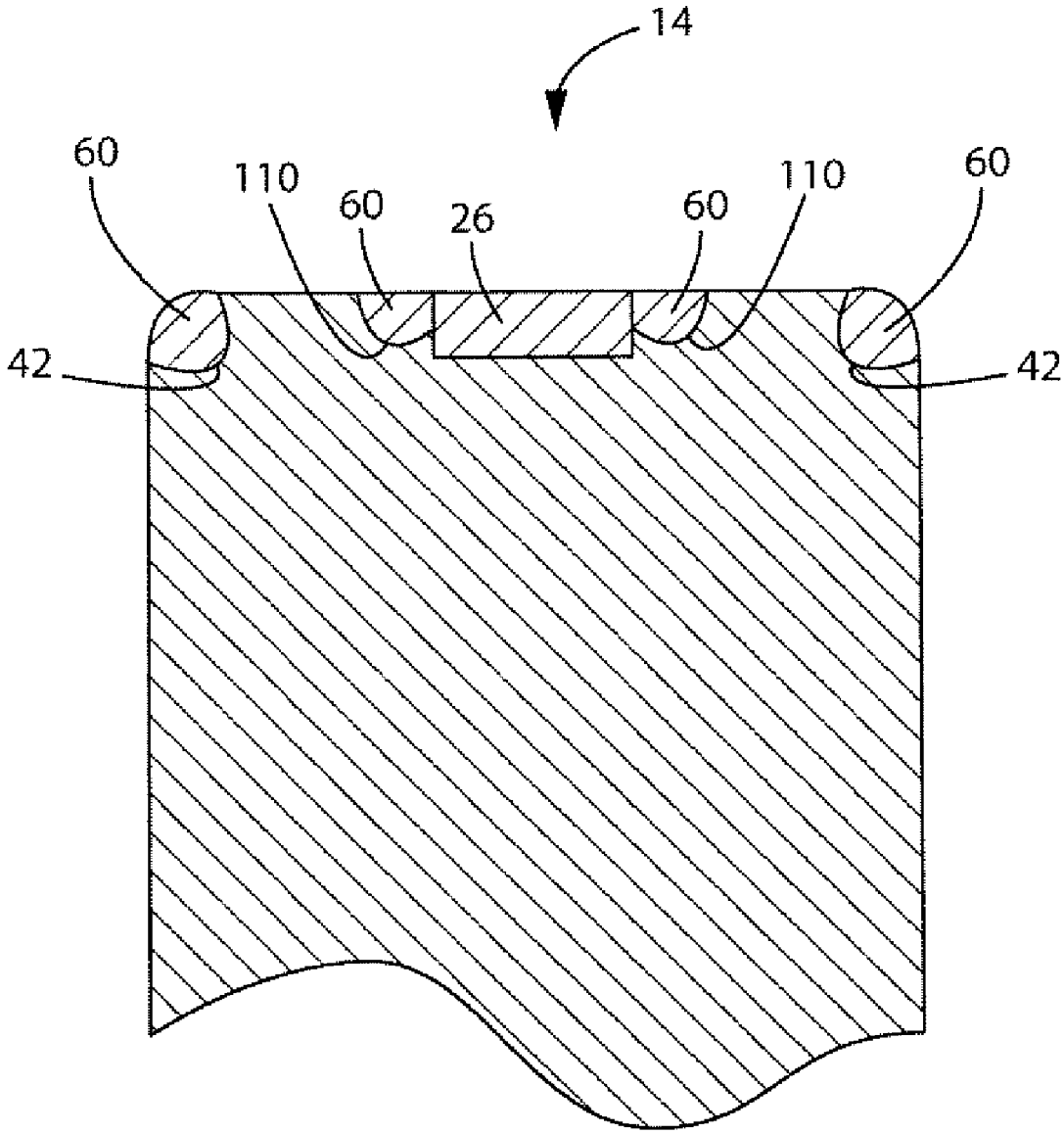
FIG. 8 is a cross-sectional view, similar to those shown in FIGS. 4 and 5, illustrating recesses formed generally around a periphery of a wear-resistant insert provided in a formation-engaging surface of a blade of an earth-boring rotary drill bit for receiving abrasive wear-resistant material therein.

FIG. 8 is a cross-sectional view of a blade 14 of another embodiment of a drill bit of the present invention. The cross-sectional view is similar to the cross-sectional views shown in FIGS. 4 and 5. The blade 14 shown in FIG. 8, however, includes a wear-resistant insert 26 that is individually substantially peripherally surrounded by recesses 110 that are filled with abrasive wear-resistant material 60. The recesses 110 may be substantially similar to the previously described recesses 42, 92 and may be filled with abrasive wear-resistant material 60. In this configuration, the exposed exterior surfaces of the wear-resistant insert 26, abrasive wear-resistant material 60, and regions of the blade 14 adjacent the abrasive wear-resistant material 60 may be generally coextensive and planar to reduce or eliminate localized stress concentration caused by any abrasive wear-resistant material 60 projecting from the blade 14 generally toward a formation being drilled. In the embodiment of FIG. 8, the abrasive wear-resistant material 60 terminates at edges defined by intersections between at least one surface defining the recess, the first exterior surface, and the second exterior surface.

Figure 9:
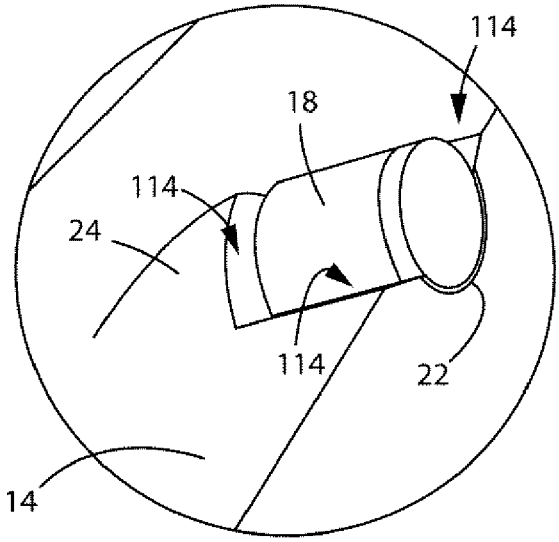
FIG. 9 is a perspective view of a cutting element secured to a blade of an earth-boring rotary drill bit and illustrating recesses formed generally around a periphery of the cutting element for receiving abrasive wear-resistant material therein.
Figure 10:
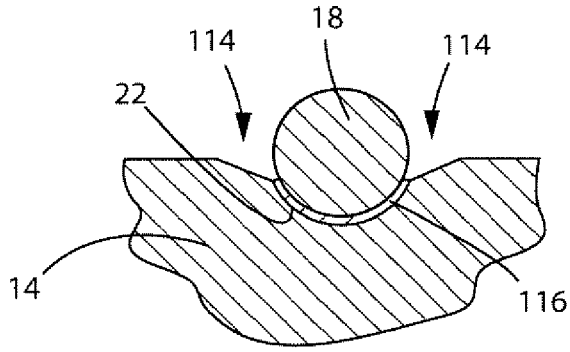
FIG. 10 is a cross-sectional view of a portion of the cutting element and blade shown in FIG. 9, taken generally perpendicular to the longitudinal axis of the cutting element, further illustrating the recesses formed generally around the periphery of the cutting element.

In additional embodiments, recesses may be provided around cutting elements. FIG. 9 is a perspective view of one cutting element 18 secured within a cutting element pocket 22 on a blade 14 of a drill bit similar to each of the previously described drill bits. As shown in each of FIGS. 9-11, recesses 114 may be formed in the blade 14 that substantially peripherally surround the cutting element 18. As shown in FIGS. 10 and 11, the recesses 114 may have a cross-sectional shape that is generally triangular, although, in additional embodiments, the recesses 114 may have any other shape. The cutting element 18 may be secured within the cutting element pocket 22 using a bonding material 116 such as, for example, an adhesive or a brazing alloy, which may be provided at an interface and used to secure and attach the cutting element 18 to the blade 14.

Figure 12:
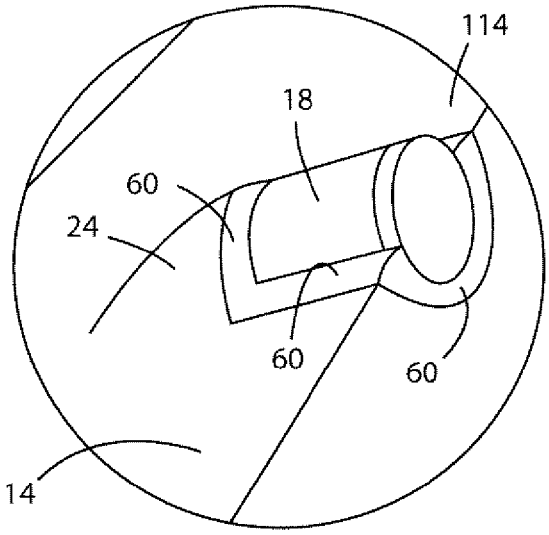
FIG. 12 is a perspective view of the cutting element and blade shown in FIG. 9 and further illustrating abrasive wear-resistant material disposed in the recesses provided around the periphery of the cutting element.
Figure 13:
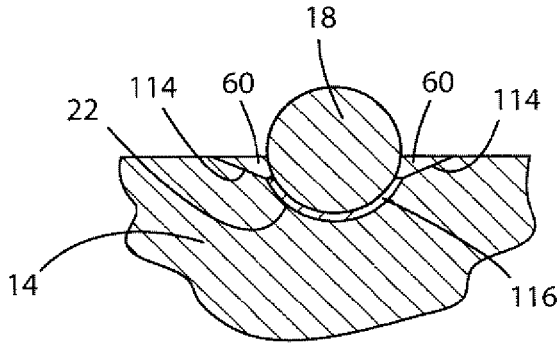
FIG. 13 is a cross-sectional view of the cutting element and blade similar to that shown in FIG. 10 and further illustrating the abrasive wear-resistant material provided in the recesses around the periphery of the cutting element.

FIGS. 12-14 are substantially similar to FIGS. 9-11, respectively, but further illustrate abrasive wear-resistant material 60 disposed within the recesses 114 provided in the blade 14 of a bit body around the cutting element 18. The exposed exterior surfaces of the abrasive wear-resistant material 60 and the regions of the blade 14 adjacent the abrasive wear-resistant material 60 may be generally coextensive. Furthermore, abrasive wear-resistant material 60 may be configured so as not to extend beyond the adjacent surfaces of the blade 14 to reduce or eliminate localized stress concentration caused by any abrasive wear-resistant material 60 projecting from the blade 14 generally towards a formation being drilled.

Additionally, in this configuration, the abrasive wear-resistant material 60 may cover and protect at least a portion of the bonding material 24 used to secure the cutting element 18 within the cutting element pocket 22, which may protect the bonding material 24 from wear during drilling. By protecting the bonding material 24 from wear during drilling, the abrasive wear-resistant material 60 may help to prevent separation of the cutting element 18 from the blade 14, damage to the bit body, and catastrophic failure of the drill bit.

FIG. 15 is an end view illustrating the face of yet another embodiment of an earth-boring rotary drill bit 120 of the present invention. As shown in FIG. 15, in some embodiments of the present invention, recesses 122 for receiving abrasive wear-resistant material 60 therein may be provided between cutting elements 18. For example, the recesses 122 may extend generally circumferentially about a longitudinal axis of the bit (not shown) between cutting elements 18 positioned in at least one of a cone region 50 (FIG. 3) and a nose region 52 (FIG. 3) of the drill bit 120. Furthermore, as shown in FIG. 15, in some embodiments of the present invention, recesses 124 may be provided rotationally behind cutting elements 18. For example, the recesses 124 may extend generally longitudinally along a blade 14 rotationally behind one or more cutting elements 18 positioned in at least one of the cone region 50 (FIG. 3) and the nose region 52 (FIG. 3) of the drill bit 120. In additional embodiments, the recesses 124 may not be elongated and may have a generally circular or a generally rectangular shape. Such recesses 124 may be positioned directly rotationally behind one or more cutting elements 18, or rotationally behind adjacent cutting elements 18, but at a radial position (measured from the longitudinal axis of the drill bit 120) between the adjacent cutting elements 18.

The abrasive wear-resistant materials 60 described herein may include, for example, a particle-matrix composite material comprising a plurality of hard phase regions or particles dispersed throughout a matrix material. The hard ceramic phase regions or particles may comprise, for example, diamond or carbides, nitrides, oxides, and borides (including boron carbide ($B_4C$)). As more particular examples, the hard ceramic phase regions or particles may comprise, for example, carbides and borides made from elements such as W, Ti, Mo, Nb, V, Hf, Ta, Cr, Zr, Al, and Si. By way of example and not limitation, materials that may be used to form hard phase regions or particles include tungsten carbide (WC), titanium carbide (TiC), tantalum carbide (TaC), titanium diboride ($TiB_2$), chromium carbides, titanium nitride (TiN), aluminum oxide ($Al_2O_3$), aluminum nitride (AlN), and silicon carbide (SiC). The metal matrix material of the ceramic-metal composite material may include, for example, cobalt-based, iron-based, nickel-based, iron- and nickel-based, cobalt- and nickel-based, iron- and cobalt-based, aluminum-based, copper-based, magnesium-based, and titanium-based alloys. The matrix material may also be selected from commercially pure elements such as, for example, cobalt, aluminum, copper, magnesium, titanium, iron, and nickel.

While embodiments of the methods and apparatuses of the present invention have been primarily described herein with reference to earth-boring rotary drill bits and bit bodies of such earth-boring rotary drill bits, it is understood that the present invention is not so limited. As used herein, the term "bit body" encompasses bodies of earth-boring rotary drill bits (including fixed cutter-type bits and roller cone-type bits), as well as bodies of other earth-boring tools including, but not limited to, core bits, bi-center bits, eccentric bits, reamers, underreamers, and other drilling and downhole tools.

While the present invention has been described herein with respect to certain preferred embodiments, those of ordinary skill in the art will recognize and appreciate that it is not so limited. Rather, many additions, deletions and modifications to the preferred embodiments may be made without departing from the scope of the invention as hereinafter claimed. In addition, features from one embodiment may be combined with features of another embodiment while still being encompassed within the scope of the invention as contemplated by the inventors.

What is claimed is:

1. An earth-boring tool comprising:

a bit body comprising:

an exterior surface;

a plurality of blades; and at least one recess extending into a body of at least one blade of the plurality of blades and intersecting a first exterior surface and a second exterior surface of the at least one blade of the plurality of blades, the at least one recess extending along an edge defined by an intersection between the first exterior surface and the second exterior surface of the at least one blade of the plurality of blades and extending along at least a gage region of the at least one blade of the plurality of blades; and a thermally applied hardfacing material disposed in the at least one recess, exposed surfaces of the hardfacing material being substantially level with the first exterior surface immediately adjacent the hardfacing material and the second exterior surface immediately adjacent the hardfacing material of the at least one blade of the plurality of blades, wherein the thermally applied hardfacing material terminates at edges defined by intersections between at least one surface defining the at least one recess, the first exterior surface, and the second exterior surface.

2. The earth-boring tool of claim 1, wherein the at least one recess is disposed adjacent at least one wear-resistant insert in the exterior surface of the bit body.

3. A method of forming an earth-boring tool, the method comprising:

forming at least one elongated recess extending into a body of a blade of a bit body of the earth-boring tool along an edge defined between a formation-engaging surface of a blade of a bit body and one of a rotationally leading surface of the blade and a rotationally trailing surface of the blade of the bit body;

extending the at least one elongated recess along at least a portion of a gage region of the blade and along at least a portion of a shoulder region of the blade;

thermally applying a hardfacing material into the at least one elongated recess;

causing exposed exterior surfaces of the hardfacing material to be substantially level with the formation engaging surface of the blade and the one of the rotationally leading surface of the blade and the rotationally trailing surface of the blade of the bit body immediately adjacent the hardfacing material; and terminating application of the hardfacing material at edges defined by intersections between at least one surface defining the at least one elongated recess, the one of the rotationally leading surface and the rotationally trailing surface, and the formation-engaging surface.

4. The method of claim 3, wherein forming at least one elongated recess comprises forming the at least one elongated recess adjacent at least one wear-resistant insert in an exterior surface of the bit body.

5. The method of claim 4, wherein forming the at least one elongated recess adjacent at least one wear-resistant insert in an exterior surface of the bit body comprises causing the at least one elongated recess to substantially peripherally surround the at least one wear-resistant insert in the exterior surface of the bit body.

6. The method of claim 3, wherein thermally applying a hardfacing material in the at least one elongated recess comprises welding the hardfacing material into the at least one elongated recess.

* * * * *